United States Patent [19]

Ernest et al.

[11] 4,209,871

[45] Jul. 1, 1980

[54] TOOTHBRUSH WITH IMPROVED INTERPROXIMAL AND FREE GINGIVAL MARGIN ACCESSIBILITY

[75] Inventors: Raymond Ernest, 170 SE. 14th St., Miami, Fla. 33131; Jack Nestor, Miami Beach, Fla.

[73] Assignee: Raymond Ernest, Miami, Fla.

[21] Appl. No.: 910,870

[22] Filed: May 30, 1978

[51] Int. Cl.[3] ..... A46B 9/04

[52] U.S. Cl. ..... 15/167 R

[58] Field of Search ..... 15/167 R, 167 A, 143 R-145, 15/172, 176; D4/15-28

[56] References Cited

U.S. PATENT DOCUMENTS

| | | | |
|---|---|---|---|
| 632,524 | 9/1899 | Goltermann | 15/184 |
| 1,632,859 | 6/1927 | Straehly | 15/172 |
| 1,647,453 | 11/1927 | Krantz | 15/167 R |
| 1,651,251 | 11/1927 | Calkins | 15/172 |
| 2,603,806 | 7/1952 | Kisky | 15/167 R |
| 2,675,573 | 4/1954 | Strong | 15/176 |
| 3,010,131 | 11/1961 | Kisky | 15/167 R |
| 3,574,879 | 4/1971 | Werding | 15/184 |
| 4,033,007 | 7/1977 | Hadary | 15/176 |
| 4,115,894 | 9/1978 | Peterson | 15/167 R |

FOREIGN PATENT DOCUMENTS

| | | | |
|---|---|---|---|
| 443435 | 9/1912 | France | 15/167 R |
| 454181 | 1/1950 | Italy | 15/167 R |
| 175862 | 6/1935 | Switzerland | 15/167 R |
| 412414 | 6/1934 | United Kingdom | 15/167 R |
| 484331 | 5/1938 | United Kingdom | 15/167 R |
| 625854 | 7/1949 | United Kingdom | 15/176 |

*Primary Examiner*—Edward J. McCarthy
*Attorney, Agent, or Firm*—Erwin M. Barnett

[57] ABSTRACT

A toothbrush has a bristle bearing head terminating the supporting stem thereof which extends from a handle. The head is disposed with its major axis at right angles to the length of the stem providing lateral extensions having bristles arranged for interproximal and free gingival margin engagement of both the maxillary and mandibular teeth. The supporting stem has a portion adjacent the head offset from a handle connecting end, the latter having a snap-in bearing connection with the handle providing easy separation and assembly and relative rotation of the handle with respect to the stem and head.

5 Claims, 7 Drawing Figures

TOOTHBRUSH WITH IMPROVED INTERPROXIMAL AND FREE GINGIVAL MARGIN ACCESSIBILITY

BACKGROUND OF THE INVENTION

1. Field of the Invention

This invention relates generally to toothbrushes and more particularly is directed to a bristle bearing head, supporting stem and handle construction providing accessibility to the interproximal spaces and beneath the free gingival margin and enabling the user to more easily manipulate the head on the buccal, labial and lingual surfaces of the maxillary and mandibular teeth.

2. Description of the Prior Art

It is currently recognized that while it is desirable with each brushing to remove as much bacterial plaque as possible from the interproximal spaces and from beneath the free gingival margin as well as from the surfaces of the teeth, the bacteria in the plaque which are responsible for tooth decay and gingival deterioration are inactivated for periods of time up to twenty-four hours by isolation of the bacteria from their grouping in a plaque form, that is, by disturbing the plaque formed on the teeth and breaking up the grouping of the bacteria. Accordingly, it is being urged that teeth be brushed in a rotary motion in an attempt to reach beneath the free gingival margin rather than in a reciprocating movement parallel to the occlusal plane and also by such rotary motion to avoid tooth structure erosion caused by reciprocating brushing.

Inasmuch as the structures of the toothbrushes currently available do not promote the use of the desired rotary brushing motion nor provide means to facilitate reaching into the interproximal spaces and beneath the free gingival margin, there is a present need to provide a toothbrush which will not only discourage brushing parallel to the occlusal plane and encourage as well as facilitate the desirable rotary brushing movement but will also provide means for reaching the interproximal spaces and beneath the free gingival margin.

SUMMARY OF THE INVENTION

Among the objects of the invention is to provide a toothbrush construction having bristles shaped, sized, located and flexible for reaching into the interproximal spaces and under the free gingival margins and which will be particularly adapted for penetrating those relatively inaccessible areas of the molars and bicuspids from the lingual cavity and the buccal cavity where the accumulation of plaque is relatively heavy, and promoting the desirable rotary brushing motion while enabling the teeth of both the maxillary and mandibular arches to be brushed simultaneously.

The invention contemplates a stem which extends from a handle and has a leading end section terminating in an elongated bristle bearing head having a major axis perpendicular to the longitudinal axis of the stem section. The bristle bearing head is formed as a back having a flat surface from which a plurality of embedded bristles project in a predetermined arrangement which is bilaterally symmetrical with respect to the transverse minor axis of the head. The bristle arrangement, which may be clustered in a plurality of tufts, includes wedge-like configurations of such tufts having one of the tufts located as an apex adjacent each opposite end of the back. The length of the head along the major axis spaces the bristles comprising the apices a distance apart to facilitate penetration into the interproximal spaces and free gingival margins of the teeth of both the maxillary and mandibular arches simultaneously when the stem, through handle manipulation, is disposed along the occlusal plane with the mouth in an open, teeth brushing, position. The tuft forming the apex of the wedge-like configuration is centrally located with respect to the rounded end of the head on the major axis, or, where the ends of the head are tapered, the tuft forming the apex is located along the trailing or leading side edges of the head. The slope of the wedge-like configuration away from each apex conforms to the scallopped contour of the gingival edges thereby improving the ability of the bristles to penetrate beneath the free margins thereof and those bristles at the apices to penetrate into the interproximal spaces at the gumline.

A trailing end section of the stem has a stub shaft which removably telescopes into the axial bore of the handle providing for separation and relative rotation therebetween. The trailing stem section may be angularly disposed to the leading stem section to offset the latter from the longitudinal axis of the handle about which the relative rotation of the stem on the stub shaft occurs to improve handling and orientation of the head in the mouth of the user.

An area of bristles adjacent the transverse minor axis of the head may be cut to a shorter length than those bristles located toward the opposite ends of the head including the bristles in the wedge-like configuration of tufts in order to facilitate the flexing of the latter in achieving their hereinbefore described intended simultaneous penetration.

A modified hourglass-shaped head provides additional wedge-like configurations of bristles and tufts spaced apart along the leading and trailing side edges of the head between the opposite ends thereof to facilitate interproximal and free gingival margin penetration when the major axis of the head is held parallel to the occlusal plane to render an additional capability to the toothbrush which is particularly useful in cleaning the front teeth.

DESCRIPTION OF THE PREFERRED EMBODIMENTS

Figure 2:
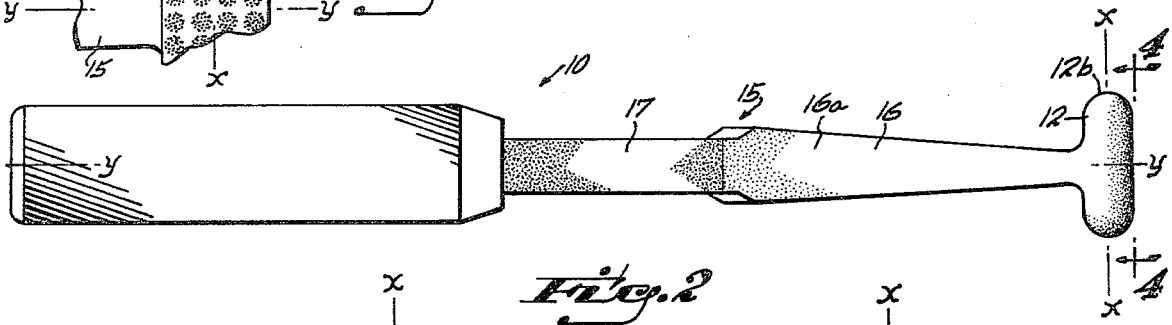
FIG. 2 is a top view of the toothbrush shown in FIG. 1.

Referring in detail to the drawing, 10 generally denotes a toothbrush constructed to embody the invention comprising a head 11 terminating the leading end of supporting stem 15 which extends from handle 20. Head 11 is formed as a back 12 which may be molded integrally with stem 15 of a suitable plastic material, well known in the art, and supports, by embedment therein, a plurality of bristles 13 arranged to project from the flat underside 12*a* thereof in a tuft pattern hereinafter described. Back 12, and thus the contour of head 11, is generally elongated, having the length or major axis x—x thereof extending perpendicular to the plane y—y in which stem 15 and handle 20 extend, as seen in FIG. 2. The opposite ends 12*b* of back 12 are rounded, while the sides therebetween are substantially parallel providing a uniform width between the rounded opposite ends 12*b*.

Figure 1:
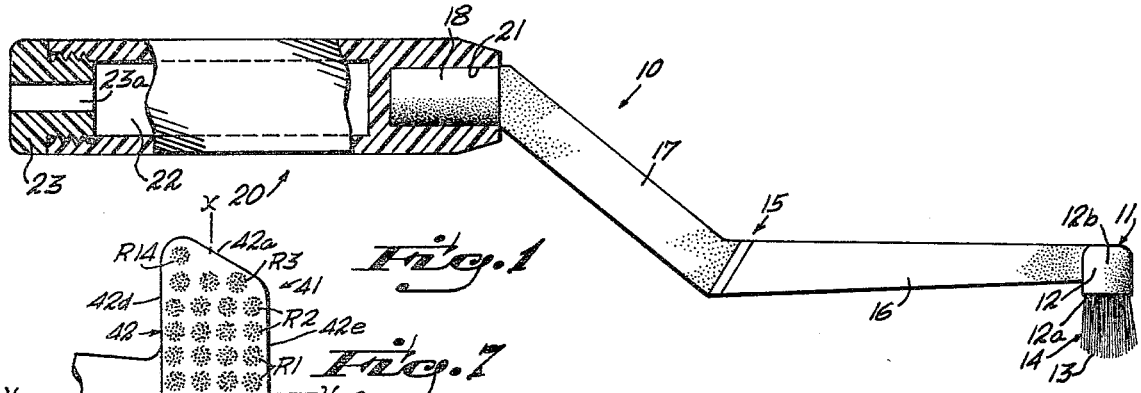
FIG. 1 is a side elevational view of a toothbrush embodying the invention showing the bristle bearing head terminating a stem having an offset from an opposite end which is pivotally and removably mounted on a handle, parts of the handle being broken away to show interior structure.
Figure 3:
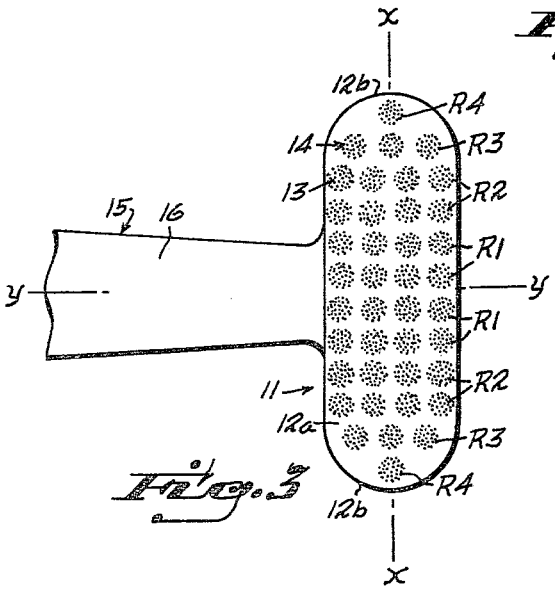
FIG. 3 is a fragmentary enlarged view of the underside of the bristle bearing head of the toothbrush shown in FIG. 2 showing details of the bristle and tuft arrangement and the wedge-like configuration at each opposite rounded end of the head.
Figure 4:
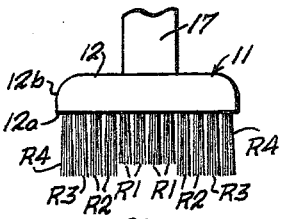
FIG. 4 is a slightly enlarged end view of the head as seen along line 4—4 in FIG. 2.

Bristles 13 are suitably arranged on perpendicularly extending head 11 to achieve the accessibility to the interproximal spaces and to the free gingival margins for the purpose and in the manner hereinbefore described. To these ends, bristles 13 may be embedded as tufts 14 in accordance with well known brush manuacturing methods. As seen in FIG. 3, the arrangement of tufts 14 is bilaterally symmetrical with respect to the minor axis of head 11, which axis is seen to lie in plane y—y. Thus, two rows R1 of four tufts 14 each are located adjacent each side of plane y—y. A second two rows R2 of four tufts 14 each and a single row R3 of three tufts 14 are located in sequence on each side of plane y—y beyond rows R1 and a single terminal tuft R4 is positioned adjacent each rounded opposite end 12*b* centralized on the major axis x—x. Rows R3 with terminal tuft R4 provide a wedge-like contour on each end of head 11 with terminal tuft R4 as an apex. Also, bristles 13 in the tufts 14 which are centrally located on back 12 in the four rows R1 may be shorter than those in rows R2, R3 and R4, as seen in FIG. 4. The ends of the longer bristles may be cut to provide a convex transverse contour with those tufts 14 located on or adjacent to the major axis x—x being longer than those located laterally, as seen in FIG. 1. Bristles 13 may be natural or made of a suitable synthetic material, such as nylon, and have a softness permitting flexure of the ends thereof sufficient for entering beneath the free gingival margins when normal brushing pressure is applied against the surface of the teeth.

Although head 11, constructed to embody the invention, may be perpendicularly mounted on a toothbrush stem and handle which are disposed coaxially with each other, an improved construction is shown as stem 15 and handle 20 in FIGS. 1 and 2. The leading end section 16 of stem 15, which terminates at the outer end in back 12, has its longitudinal axis fixed in perpendicular relation to the major axis x—x of head 11. The opposite or inner end of section 16 is integrally formed with an offsetting, angularly disposed section 17 and tapers slightly in thickness from its inner end toward head 11, as seen in FIG. 1, leading end section 16 being of a length to substantially position section 17 entirely on the exterior of the lips of the user in all operative positions of head 11. Widthwise, section 16 may be broader at the inner end than section 17 and also tapers toward head 11, as seen in FIG. 2. This enlargement of section 16 adjacent section 17 provides an upfacing surface area 16*a* to which pressure may be applied by the index finger or thumb for in turn exerting pressure by bristles 13 against the teeth. A cylindrical stub shaft 18 terminates the rearward end of section 17 and is positioned with its axis extending parallel to the longitudinal axis of section 16.

Handle 20, which is cylindrically shaped and sized to fit the user's hand to be grasped thereby for manipulation of head 11 within the mouth in the preferred manner, has, at its leading end, an axial bore 21 sized to telescopingly engage stub shaft 18 for separation therefrom and rotation thereon. Rearwardly of bore 21, handle 20 may be hollow, providing a storage chamber 22 fitted with a screw cap 23 which may have a central opening 23*a* for access to chamber 22 when cap 23 is in mounted position.

Figure 5:
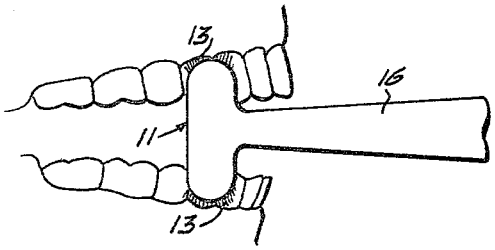
FIG. 5 is a side view of the maxillary and mandibular arches inside the mouth in open position showing the toothbrush in FIG. 1 in an operative, toothbrushing, position wherein the bristles engage the buccal surfaces of the teeth and extend beneath the free gingival margins of both arches.

The practical utility and operation of toothbrush 10 will now be apparent. To brush one side of the mouth, toothbrush 10 is comfortably gripped in the opposite hand, as for example, by three fingers being curled around handle 20 so that angularly disposed section 17 extends between the thumb and index finger for disposing leading end section 16 along the occlusal plane to readily position head 11 in the buccal or lingual cavity with bristles 13 engaging the teeth. The jaws are held open sufficiently but in a relaxed fashion to position tufts R4 of the opposite ends of head 11 at the gumline of both the mandibular and maxillary arches as illustrated in FIG. 5. The brushing, to achieve the desired result of breaking up organized bacterial plaque, is performed by applying light pressure against the teeth sufficient to flex the ends of the longer bristles 13 in rows R2, R3 and R4. Head 11 is moved in a circular motion, which more precisely may be elliptical, with the major axis of the ellipse extending vertically and parallel to the major axis x—x of head 11. The perpendicular disposition of the major axis x—x of head 11 with respect to stem 15 and the arrangement of tufts 14 in accordance with the invention is particularly adaptable to and facilitates this desirable brushing motion whereby the wedge-like contour of tufts 14 provided by rows R3 and R4 penetrates the interproximal spaces at the base of the teeth and by said flexure of bristles 13, the latter also extend beneath the free gingival margin along the entire width of each tooth. The circular brushing motion is applied while slowly advancing stem 15 along the occlusal plane. In this manner the buccal surfaces of the teeth of the entire half of the mouth may be carefully brushed, and then by rotating stem 15 180° in handle 20, the lingual surfaces of the teeth of the same half of the mouth may likewise be brushed. The offset of leading end section 16 with respect to handle 20 makes the lingual surfaces as well as the buccal surfaces of the teeth readily accessible. The other half of the mouth is then similarly brushed holding handle 20 in the opposite hand.

The use of toothbrush 10 is not necessarily limited to the simultaneous brushing of the mandibular and maxillary arches but is also adaptable to brushing each arch individually by the same hereinbefore described rotary movement particularly when brushing the canines and incisors at the front of the mouth.

The occlusal surfaces of the teeth are brushed by conventional short reciprocating strokes but utilizing the bristles 13 on one half of head 11, or, if desired, handle 20 may be held perpendicular to the arches thereby aligning axis x—x for reciprocal movement along the arches and brushing with the bristles of the entire head 11.

Head 11 of toothbrush 10 may be proportioned for the intended use thereof, for example, in a regular adult size and in a smaller child size. For adult use, an average overall length for back 12 of approximately 24 mm. and width of 10 mm. satisfy the size requirements of most adult mouths. The length of the longer bristles 13 in rows R2, R3 and R4 are preferably 10 mm. while rows R1 are approximately 8 mm. long.

Figure 7:
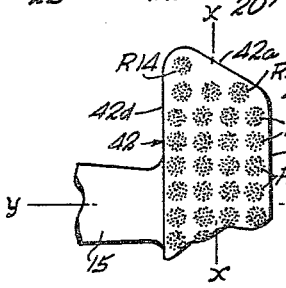
FIG. 7 is a fragmentary view of one end of another modified form of bilaterally symmetrical head taken similar to FIG. 3, wherein the opposite ends are tapered and the apex tufts are located adjacent the trailing side edge of the head.

In keeping with the concept of providing a wedge-like configuration of tufts 14 formed by rows R3 and R4 at each of the opposite ends of back 12, FIG. 7 shows a modification thereof as head 41 having a back 42 integrally formed with stem 15. The opposite ends **42*a* of back 42, instead of being rounded as ends 12*a* of back 12, are tapered forwardly so that terminal tuft R14 may be positioned adjacent the trailing side edge 42*d* which because of said taper is longer than leading side edge 42*e*. Rows R1, R2 and R3 of tufts on back 42 are in the same arrangement as those on back 12, but terminal tuft R14, as the apex of the wedge-like configuration, is located to one side of major axis x—x. It will be apparent that, the tapered end 42*a* tapering from a longer trailing side edge 42*d* to a shorter leading side edge 42*e* as illustrated in FIG. 7** conforms to the contour of the buccal and lingual cavities in the molar region of the mouth facilitating brushing therein in the manner hereinbefore described and minimizing irritation to the mucco-buccal fold.

Figure 6:
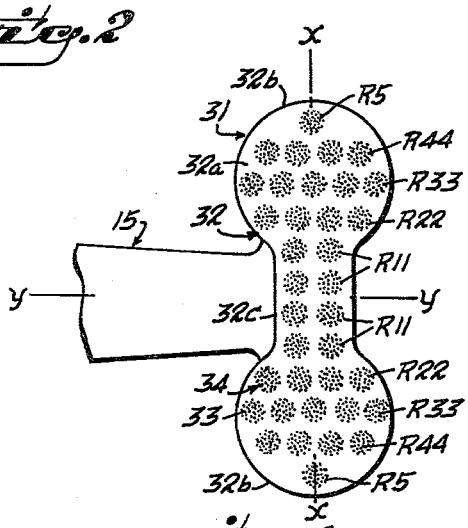
FIG. 6 is a view similar to FIG. 3 but showing a modified form of head having an hourglass shape for locating bristles and tufts in additional wedge-like configurations along the opposite side edges of the head.

Another modified form of toothbrush head is shown in FIG. 6 as head 31 which comprises a back 32 integrally formed with stem 15 and having a flat underside **32*a* from which bristles 33 project in a predetermined pattern of tufts 34. Back 32 has an hourglass contour which provides a pair of opposite end sections 32*b*, each having a rounded or circular shape, interconnected by a constricted midportion 32*c*. In a manner comparable to head 11, tufts 34 are in a bilaterally symmetrical arrangement with respect to the minor axis of head 31, that is, with respect to plane y—y, whereby two rows R11 of two tufts 34 each are adjacent to each side of plane y—y. Thereafter, located in sequence on each side of plane y—y beyond rows R11 are one row R22 of four tufts 34, one row R33 of five tufts 34, one row R44 of four tufts and a single terminal tuft R5 positioned at the extreme opposite ends of back 32** on the major axis x—x.

In addition to using toothbrush 10, when fashioned with head 31 having opposite end wedge-like configurations provided by tufts 34 located in rows R5 and R44, in a manner similar to that hereinbefore described for head 11, the tufts 34 located at the opposite ends of rows R22, R33 and R44 form a wedge-like configuration on the opposite sides of each end section **32*b* whereby head 31 may be applied to the teeth with major axis x—x extending parallel to the occlusal plane instead of perpendicular thereto by holding handle 20 in a vertical position. Circular or elliptical brushing movement, imparted by head 31, particularly for brushing the front teeth, will enable the tufts 34 in the wedge-like configurations located along the sides of head 31 to penetrate the interproximal spaces and the free gingival margins in a manner similar to that of the wedge-like configurations at the opposite ends of heads 11 and 31** when the latter are held perpendicular to the occlusal plane.

Fewer than the twelve rows of tufts 14 and 34 may be used within the scope of the invention as dictated by the dimensions of backs 12, 42 and 32 and the size of the respective tufts 14 and 34. Thus, one row R2 on each end of backs 12 and 42 and/or fewer than four rows R1 may be provided. Also, tufts 14 may be three abreast instead of the four abreast illustrated in FIGS. 3 and 7. Likewise, fewer than four rows R11 may be used on back 32 and tufts 34 in each of the rows R11, R22, R33 and R44 may be reduced in number. The bristles 33 in rows R11 of back 32 may be shorter than those of the rows of end sections **32*b* in a manner similar to back 12. However, the transverse contour of bristles 33 of end sections 32*b* may be flat rather than convex as bristles 13 shown in FIG. 1**.

Where so desired, bristles 13 and 33 may be mounted in backs 12, 41 and 31, respectively, as unitary or pairs of bilaterally symmetrical tufts having configurations providing the wedge-like contours shown and described with respect to heads 11, 41 and 31.

By requiring as well as facilitating the hereinbefore described circular or elliptical brushing motion on the buccal and lingual surfaces of the teeth, the perpendicular relationship between major axis x—x of heads 11, 41 and 31 and the longitudinal axis of leading end section 16 and handle 20, embodying the invention, also prevents, or at the very least greatly discourages, continued use of the undesirable brushing habit of taking long and hard strokes across the buccal and lingual surfaces of the teeth in a direction parallel to the occlusal plane. Thus, erosion of the surface layer of the teeth, particularly along the dento-enamel junction, the cause of which has been attributed, to a large degree, to such parallel brushing, is substantially eliminated or at least materially reduced by the use of toothbrush 10 fitted with heads 11, 41 or 31.

The readily separable connection between handle 20 and stem 15 permits one handle to service a plurality of stems 15 each fitted with a toothbrush head embodying the invention, one or more for each member of the family, or also fitted with a gum massaging instrument such as a periodontal aid. The offset feature of leading end 16 with respect to handle 20 may be preserved without the relative rotation of stem 15 in handle 20 by enlarging integrally formed stub shaft 18 to a convenient handle size.

Storage chamber 22 may be used to house a spool of dental floss (not shown), the leading end of which may be fed through central opening **23*a* in screw cap 23**, or, when traveling, a small tube or container of tooth paste or powder may be carried therein.

The toothbrush constructions herein disclosed are seen to achieve the several objects of the invention and to be well adapted to meet conditions of practical use. As various possible embodiments might be made of this invention, and as various changes might be made in the disclosed toothbrushes, it is to be understood that all matters herein set forth or shown in the accompanying drawing are to be interpreted as illustrative and not in a limiting sense.

What is claimed is:

1. A toothbrush construction having the capability for simultaneously penetrating the interproximal spaces and under the free gingival margins of the teeth of both the maxillary and mandibular arches comprising, a stem extending from a handle, a leading end section of said stem having a longitudinal axis, said leading end section terminating in an elongated bristle bearing head having a major axis extending between opposite ends of said head and perpendicular to said longitudinal axis, said bristle bearing head comprising a back having a substantially flat surface, a plurality of bristles projecting from said flat surface in a predetermined arrangement bilaterally symmetrical with respect to a minor axis of said head, said stem longitudinal axis being coaxial with said minor axis, said predetermined bristle arrangement including a wedge-like configuration having an apex located adjacent each of said opposite ends, the length of said head between said apices being on the order of 24 mm such as to position each apex at the gingival margin of each of said arches when the mouth is in an open position and said handle disposes said stem longitudinal axis in the occlusal plane.

2. The toothbrush construction defined in claim 1 in which the apices of said wedge-like configuration are located along said major axis of the head.

3. The toothbrush construction defined in claim 1 in which the opposite ends of said back taper from a trailing side edge to a relatively shorter leading side edge, and the apices of said wedge-like configuration being located adjacent said trailing side edge.

4. The toothbrush construction defined in claim 1 in which said handle has a longitudinal axis parallel to and offset from said longitudinal axis of the leading end section of the stem, said stem having an angularly disposed section interconnecting said leading end section and handle in said offset, parallel relation, said handle and angularly disposed stem section being separable for interchange of the handle with another stem, and means separably interconnecting said handle and angularly disposed stem section including a stub shaft terminating said angularly disposed stem section, an axial bore formed in said handle communicating with one end thereof into which said stub shaft telescoping fits for relative rotation of said stem and head with respect to said handle.

5. A toothbrush construction having the capability for simultaneously penetrating the interproximal spaces and under the free gingival margins of the teeth of both the maxillary and mandibular arches comprising, a stem extending from a handle, a leading end section of said stem having a longitudinal axis, said leading end section terminating in an elongated bristle bearing head having a major axis extending between opposite ends of said head and perpendicular to said longitudinal axis, said bristle bearing head comprising a back having a substantially flat surface with an hourglass contour providing circular shaped opposite end sections, a plurality of bristles projecting from said flat surface in a predetermined arrangement bilaterally symmetrical with respect to a minor axis of said head, said stem longitudinal axis being coaxial with said minor axis, said predetermined bristle arrangement having a configuration conforming substantially to said hourglass contour including a first pair of wedge-like configurations having apices located adjacent each of said opposite ends, the length of said head between said apices being such as to position each apex at the gingival margin of each of said arches when the mouth is in an open position and said handle disposes said stem longitudinal axis in the occusal plane, said predetermined bristle arrangement including second pairs of wedge-like configurations, one pair for each of said end sections, one wedge-like bristle configuration of each of said second pairs being located along an opposite side edge of the section whereby said head, when applied to the teeth with said major axis extending parallel to the occlusal plane, positions said second wedge-like configurations for penetration into the interproximal spaces and under the free gingival margins of the teeth.

* * * * *